US006709698B1

(12) United States Patent
Bethune

(10) Patent No.: US 6,709,698 B1
(45) Date of Patent: Mar. 23, 2004

(54) METHOD AND APPARATUS FOR APPLYING A COATING SUCH AS A PAINT OR A VARNISH

(75) Inventor: Alain Bethune, Savigny (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/330,134

(22) Filed: Jun. 11, 1999

(30) Foreign Application Priority Data

Jul. 3, 1998 (FR) ..... 98 08544

(51) Int. Cl.[7] ..... B05D 1/02; B05D 3/12; B05D 7/22

(52) U.S. Cl. ..... 427/233; 427/231; 427/236; 427/240; 427/385.5; 427/393.5; 427/425; 118/52; 118/55; 118/320

(58) Field of Search ..... 427/240, 425, 427/230, 231, 232, 346, 385.5, 64, 164, 233, 236, 393.5; 118/52, 55, 320

(56) References Cited

U.S. PATENT DOCUMENTS

| | | | | | |
|---|---|---|---|---|---|
| 3,804,663 | A | * | 4/1974 | Clark | 117/101 |
| 5,002,799 | A | * | 3/1991 | Iwasaki | 427/72 |
| 5,599,579 | A | * | 2/1997 | Iwasaki | 427/64 |
| 5,658,615 | A | * | 8/1997 | Hasebe et al. | 427/240 |
| 5,695,817 | A | * | 12/1997 | Tateyama et al. | 427/240 |
| 5,711,809 | A | | 1/1998 | Kimura et al. | |
| 5,725,903 | A | | 3/1998 | Rostoker | |
| 5,753,301 | A | * | 5/1998 | Brytsche et al. | 427/162 |
| 5,762,708 | A | | 6/1998 | Motoda et al. | |
| 5,763,004 | A | * | 6/1998 | Hammen | 427/231 |
| 6,165,552 | A | * | 12/2000 | Anai et al. | 427/240 |

FOREIGN PATENT DOCUMENTS

| | | | |
|---|---|---|---|
| DE | 25 59 144 | A1 | 6/1977 |
| DE | 3420859 | A1 | 12/1985 |
| EP | 0 139 478 | B1 | 6/1989 |
| EP | 0 556 784 | A1 | 8/1993 |
| JP | 54-93015 | | 7/1979 |
| JP | 62 155965 | A | 7/1987 |
| JP | 63 134076 | A | 6/1988 |
| JP | 05 259052 | A | 10/1993 |
| JP | 06 089868 | A | 3/1994 |
| JP | 07 185414 | | 7/1995 |
| JP | 07 240360 | | 9/1995 |
| JP | 07 240360 | A | 9/1995 |
| JP | 08 148413 | A | 6/1996 |
| JP | 08 315729 | A | 11/1996 |
| WO | WO 98/11998 | | 3/1998 |

* cited by examiner

*Primary Examiner*—Shrive P. Beck
*Assistant Examiner*—Kirsten Crockford Jolley
(74) *Attorney, Agent, or Firm*—Oliff & Berridge, PLC

(57) ABSTRACT

A method of applying a coating such as a varnish or a paint on a hollow article. The method includes the operation consisting in depositing a predetermined quantity of coating in the fluid state on the center of a surface of the article, and in spreading it by causing the article to revolve.

25 Claims, 3 Drawing Sheets

METHOD AND APPARATUS FOR APPLYING A COATING SUCH AS A PAINT OR A VARNISH

The present invention relates to a method and apparatus for applying a coating such as a paint or a varnish on an article.

BACKGROUND OF THE INVENTION

It is well known to cover the surface of an article of plastics material in a varnish that is designed, for example, to protect decoration provided thereon.

In conventional manner, the varnish is sprayed by means of a spray gun in a painting or varnishing station.

That method requires the use of paints or varnishes that need to be diluted in organic solvents, which solvents must be eliminated prior to polymerization.

Such elimination by evaporation is harmful to the environment.

In addition, solvent evaporation does not make it easy to recycle any paint or varnish that may be recovered.

Finally, the painting or varnishing station is generally situated at a location that is remote from the station where molding takes place, so while the article is being conveyed to the painting or varnishing station, it is exposed to being dirtied, and in some cases there is a risk of the decoration formed thereon being damaged.

There thus exists a need to reduce loss of varnish and to facilitate the operation of varnishing, and more generally to perform the operation of depositing a coating such as paint or varnish on an article in a manner that is more effective.

OBJECTS AND SUMMARY OF THE INVENTION

The present invention provides a novel method of applying a coating such as paint or varnish on a hollow article, in particular an article made of molded plastics material such as the body of a container, a container lid, a stopper, or a flask, with the opening of the flask possibly being narrower than the bottom thereof.

The method includes the operation consisting in depositing a predetermined quantity of coating in the fluid state on the center of a surface of the article, and in spreading it by causing the article to revolve.

By means of the invention, the coating is deposited on the article without needing prior dispersion in the atmosphere in the form of fine droplets.

The invention thus makes it possible to reduce the quantity of paint or varnish that comes into contact with the atmosphere, and thus to reduce losses of solvent by evaporation.

The invention thus makes it possible to use a conventional varnish or paint that does not have organic solvents and that is easy to recycle.

The varnish or paint without solvent is advantageously heated, preferably being raised to a temperature that is higher than ambient temperature, for example a temperature in the range 40° C. to 50° C., for the purpose of increasing its fluidity.

By way of example of a coating that does not have organic solvents, mention can be made of the following composition:

- oligomers (urethane/acrylate oligomers);
- polyfunctional monomers (acrylates) having strong double bonds; and
- photoinitiators (3% to 8%, and preferably 4% to 5%).

The coating can be applied automatically in a closed enclosure, close to the molding station, since said enclosure is more compact than are traditional installations.

This reduces the extent to which the article is at risk during transport of possible dirtying and of damage to decoration on the article, if any.

In a particular implementation of the method of the invention, the surface on which the coating is deposited is situated inside the article, and the quantity of coating that is deposited is sufficient to enable it to rise under the effect of centrifugal force at least some of the way along the side wall of the article.

Surprisingly, the coating deposited on the bottom of the inside surface rises under the effect of centrifugal force along the side wall of the article, even if the side wall is vertical.

It is thus possible by means of the invention to paint an article whose side wall is parallel to the axis of rotation, whether or not the wall is a body of revolution.

Thus, in an implementation of the method of the invention, the side wall of the article is at least in part cylindrical about the same axis as the axis of rotation about which the article is driven.

The side wall of the article can be stepped.

Still in a particular implementation of the method of the invention, a quantity of coating is deposited on the bottom of the article that is sufficient to enable it to cover the top edge of the article after it has moved up along the side wall thereof.

The invention also makes it possible to paint or varnish articles which cannot be painted or varnished by conventional spraying, either because the opening is too small to enable a spray nozzle to be inserted inside the article, or else because the air present in the bottom of the article constitutes a buffer of gas that tends to oppose diffusion of the sprayed aerosol.

The invention thus makes it possible to paint an article of small section or a flask whose opening is narrower than its bottom.

When the coating that is used does not include any solvent, there is no harm in depositing the coating in excess on the surface to be coated since it is easy to recycle any residual quantity of coating that is ejected from the article during rotation thereof without any risk of harming the environment.

After the coating has spread over the inside surface of the article, rotary drive to the article is preferably stopped immediately, e.g. by stopping the drive mechanism, for the purpose of avoiding any coating running over the outside surface of the article.

In a particular implementation of the method of the invention, the coating which spreads under the effect of centrifugal force is deposited on a surface which is itself substantially plane or slightly convex and situated on the outside of the article.

To paint or varnish such a surface, the method advantageously includes the operations consisting in:

- depositing a predetermined quantity of coating in the fluid state on the center of said surface, and spreading it by causing the article to spin; and
- applying the coating directly on at least a portion of the remainder of the surface of the article.

These two operations can begin simultaneously or they can be performed one after the other, in whichever order is most suitable for the shape of the article that is to be painted or varnished.

The coating can be applied by means of a jet or a spray or by any other means, and it can be applied over the entire outside surface of the article that is not covered by the coating spreading under the effect of centrifugal force.

Advantageously, while the coating for spreading under the effect of centrifugal force is being deposited on the outside surface of the article, its speed of rotation is zero or very small (e.g. less than 5 revolutions per second (rps)) to avoid any risk of coating being thrown off on first contact with the article.

Preferably, on starting up, the speed of rotation of the article increases very quickly so as to avoid any running associated with the shape of the surface over which the coating spreads.

For example, the article can reach a speed of rotation lying in the range 50 rps to 100 rps in less than 1 second.

The coating can be applied directly to the outside surface of the article by means of a nozzle whose position and orientation are adjustable.

Thus, in a particular implementation of the method of the invention, where the substantially plane or slightly convex surface is generally rectangular in shape when observed from above at the moment when it is set into rotation for spreading the coating under the effect of centrifugal force, the means for applying the coating directly to the surface of the article comprise a nozzle that slopes downwards and that is situated slightly above the periphery of said substantially plane or slightly convex surface.

Advantageously, to paint or varnish inside and/or outside surfaces of an article, the coating used is one that is capable of being cured under the effect of ultraviolet radiation.

Curing of the coating deposited on the article is preferably induced while the article is still rotating.

The invention also provides apparatus for applying a coating on an article having at least one surface that is substantially plane or slightly convex, the apparatus comprising:

a rotary support for rotating the article;

a dispenser member for depositing a predetermined quantity of coating in the fluid state on a predetermined location of said surface; and means for applying the coating directly on at least a portion of the surface of the article that is not covered by the coating being spread under the effect of centrifugal force.

The term "a surface which is substantially plane or slightly convex" is used to designate any surface which can be covered by spreading under the effect of centrifugal force spreading a coating deposited in the center thereof.

The apparatus preferably has an enclosure within which the article is rotated.

Also preferably, the means for applying the coating directly on the article comprise a nozzle whose inclination and positioning relative to the rotary support are adjustable.

When the paint or varnish used can be cured under the action of ultraviolet radiation, the apparatus further includes means for exposing the article to ultraviolet radiation.

In a particular embodiment, the dispenser member is connected to a tank containing a coating without organic solvent.

Still in a particular embodiment, the apparatus includes means for heating the coating.

The invention is particularly suitable for applying a coating to a hollow article such as the body of a container, a container lid, a stopper, or a flask.

When the article has an outside surface that is substantially plane or slightly convex that is generally rectangular in shape when observed from above at the time when it is rotated to spread the coating under the effect of centrifugal force, the means for applying the coating directly to the remainder of the surface of the article advantageously include a downwardly-sloping nozzle situated slightly above the periphery of said substantially plane or slightly convex surface.

It has been observed, quite surprisingly, that the invention makes it possible to paint or varnish in satisfactory manner articles that are not circularly symmetrical, and in particular lids of rectangular shape.

It has been found that by applying the paint or varnish in the form of a jet or a spray to the sides of the lid, it is possible when the nozzle is suitably placed to cover the corners of the lid which are not reached by the paint or varnish spreading under the effect of centrifugal force, but without that giving rise to excess paint or varnish at any location on the surface of the article.

The invention also provides a painted or varnished hollow article having a surface covered in a coating spread under the effect of centrifugal force.

The article may have at least a portion of its surface which is covered by a coating that is deposited by direct application, e.g. by being delivered by means of a nozzle.

The thickness of the deposited coating lies advantageously in the range 3 $\mu$m to 30 $\mu$m, and preferably in the range 8 $\mu$m to 25 $\mu$m.

The article may constitute the body of a container, a container lid, a stopper, or a flask.

The coating used is advantageously a paint or a varnish without organic solvent.

BRIEF DESCRIPTION OF THE DRAWINGS

The invention will better understood on reading the following description and on examining the accompanying drawings, in which.

MORE DETAILED DESCRIPTION

Figure 1:
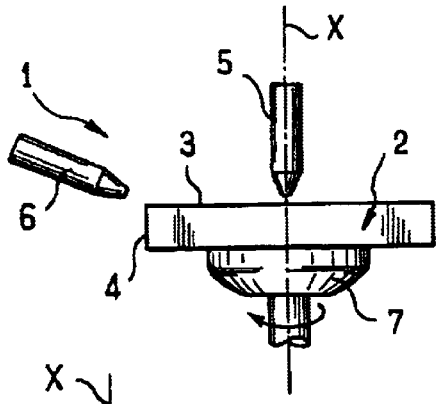
FIG. 1 is a diagrammatic elevation view of a device for implementing the method of the invention.

FIG. 1 shows apparatus 1 for applying a coating such as a paint or a varnish to an article 2.

In this case, the article 2 is constituted by the lid of a makeup container that is generally rectangular in shape.

The top 3 of the lid 2 is substantially plane and horizontal, and its sides 4 are substantially vertical and they extend downwards.

The top 3 of the lid 2 could also be outwardly convex, for example.

The apparatus 1 comprises firstly a dispenser member enabling a drop of paint or varnish to be deposited on the center of the surface constituting the top 3 of the a lid 2, and secondly means for applying paint or varnish directly to the sides 4 of the lid 2 and in its corners, said means being constituted by a nozzle 6 as shown, for example.

The apparatus 1 also has means 7 for supporting the lid 2 and capable of rotating it about a vertical axis of rotation X.

The lid 2 rotates inside an enclosure that is not shown.

Figure 2:
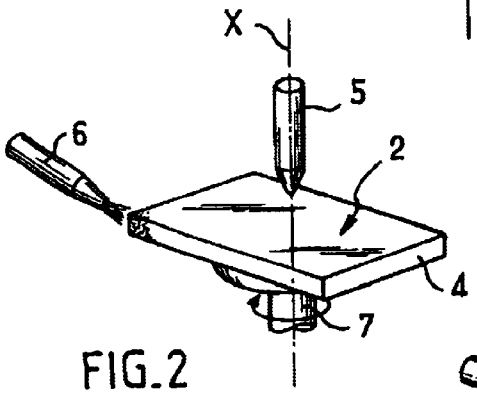
FIGS. 2 and 3 show respectively the operations of depositing the coating on the sides of the article and dispensing a drop of paint or varnish in the center of its substantially plane surface.
Figure 3:
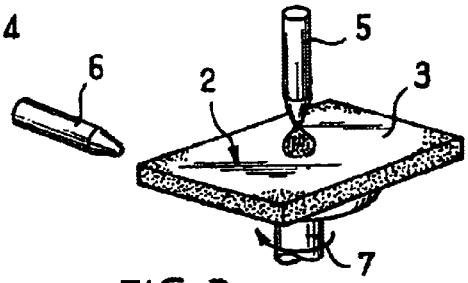

Preferably, paint or varnish is initially applied by means of the nozzle 6 to the side surface of the article 2 so as to cover its sides 4, as shown in FIG. 2.

During this operation, which is short and lasts for less than half a second in the example described, the article 2 is rotated-about the axis X to perform one revolution.

The nozzle 6 slopes slightly obliquely downwards and is situated slightly above the lid 2 so as to be able to reach its corners.

When a coating is used that does not have organic solvent, the coating is delivered by the nozzle 6 in the form of a jet and not in the form of an aerosol.

When application by means of the nozzle 6 comes to an end, the lid 2 is stopped.

The dispenser member 5 is then used to deposit a drop of paint or varnish on the center of the plane surface of the lid.

After the drop of paint or varnish has been deposited on the lid, the lid is set into rotation very quickly so as to reach its nominal speed of rotation, e.g. lying in the range 50 rps to 100 rps in less than 0.5 s.

Figure 4:
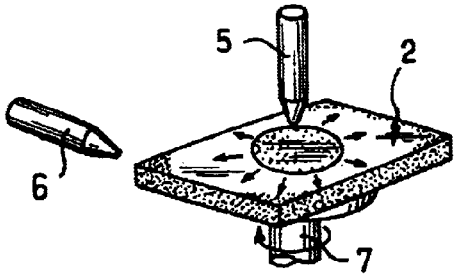
FIG. 4 shows the coating spreading under the effect of centrifugal force.

Under the effect of centrifugal force, the drop as deposited in this way spreads out and progressively covers the top 3 of the lid, as shown in FIG. 4.

The part is kept rotating at a speed of 50 rps to 100 rps for a period of 2 s to 5 s in the example described.

After a certain amount of time, the regions covered by the spreading of the drop of paint or varnish meet the regions already covered by the nozzle 6, and as a result the outside surface of the lid 2 is entirely covered in paint or varnish and the junction between the regions respectively painted or varnished by the effect of centrifugal force and by the nozzle 6 is not easily discernible.

Preferably, the paint or varnish without solvent that is used is one that is capable of being cured under the action of ultraviolet radiation.

In the example described the coating is heated to 45° C. so as to make it more fluid.

When using a coating without solvent and when excess coating is deposited on the article, any coating that is throw off the article can be recovered inside the enclosure and recycled, merely after a filtering operation.

Figure 5:
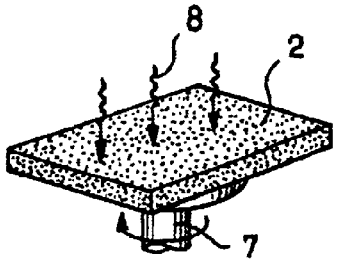
FIG. 5 represents the article coated in this way being exposed to ultraviolet radiation.

Once the paint or the varnish has been deposited, the lid is kept rotating and it is subjected to ultraviolet radiation 8 to cause curing to take place, as represented in FIG. 5.

Figure 6:
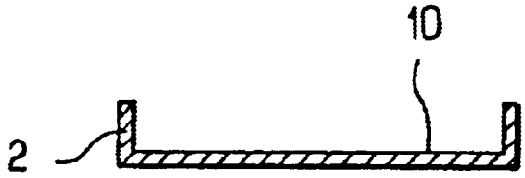
FIG. 6 is a diagrammatic axial section through an article whose inside surface is to be painted.

To paint or varnish the inside surface of the lid 2, the lid is placed upside-down on the rotary support 7, as shown in FIG. 6, with its opening facing upwards.

Figure 7:
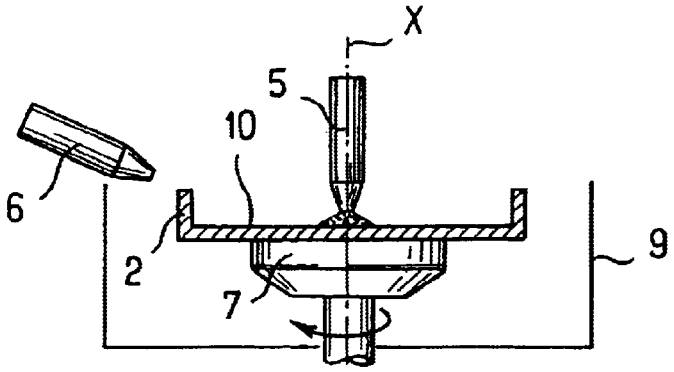
FIGS. 7 to 10 show how the coating is applied to the inside surface of the article.

Thereafter, the dispenser member 5 is used to deposit a drop of coating on the center of the bottom 10 while the lid is already being rotated, as shown in FIG. 7.

Figure 8:
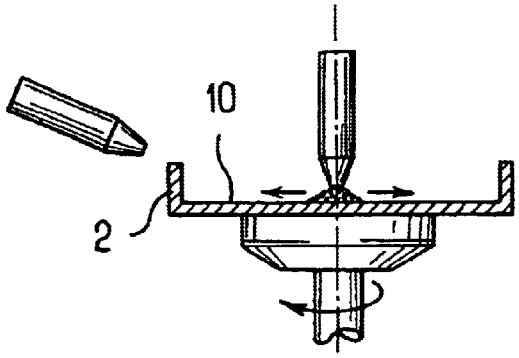
Figure 9:
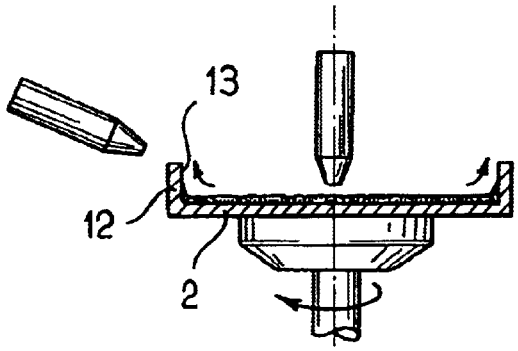

Under the effect of centrifugal force, the coating spreads out to cover all of the bottom 10 of the article 2, as shown in FIGS. 8 and 9.

As in the preceding example, the coating used is preferably a paint or varnish without organic solvent, said coating being slightly heated prior to application, e.g. being raised to a temperature of 45° C.

If the quantity of coating is sufficient and the speed of rotation is fast enough, then the coating rises up the inside surface 13 of the side wall 12 of the lid 2, as shown in FIG. 9.

This result is surprising since the inside surface 13 is parallel to the axis X.

Figure 10:
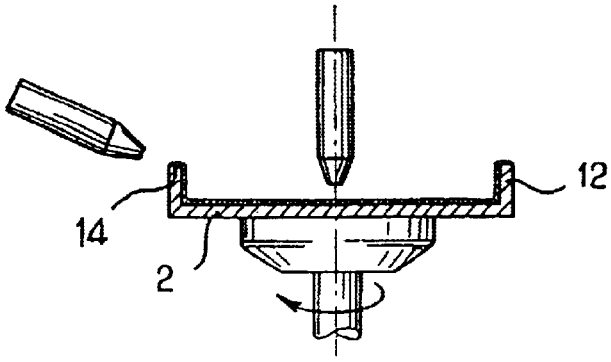

The coating can even reach the top edge 14 of the lid 2, as shown in FIG. 10.

Rotation of the lid is therefore reduced as quickly as possible to zero in order to avoid any risk of the coating running down the outside surface of the side wall 12 of the lid 2.

The nozzle 6 is not used when coating is being deposited on the inside surface of the article.

After the coating has been deposited and has spread out, the article is subjected, for example, to ultraviolet radiation to cause it to polymerize.

Naturally, any hollow article can be painted or varnished in this manner, e.g. the body of a container, a container lid, a stopper, or a flask, and the article can be cylindrical or otherwise, of circular section or otherwise, and it can have an opening whose section lies, for example, in the range 0.25 $cm^2$ to 10 $cm^2$.

Figure 11:
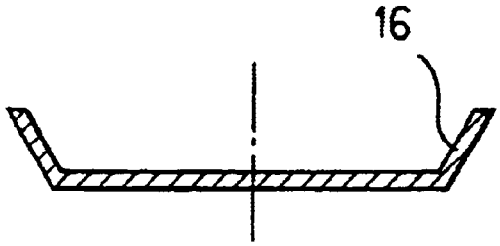
FIGS. 11 and 12 are diagrammatic axial sections showing articles of other shapes.
Figure 12:
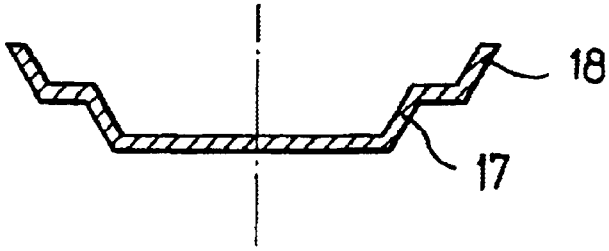

As an illustration, FIGS. 11 and 12 show two hollow articles which are circularly symmetrical, having a frusto-conical side wall 16 that flares upwards in the example of FIG. 11 and a side wall that is stepped, having two frusto-conical portions 17 and 18 as shown in FIG. 12.

The invention makes it easy to deposit paint or varnish on an article to a thickness lying in the range 3 $\mu$m to 30 $\mu$m, for example, with said thickness preferably lying in the range 8 $\mu$m to 25 $\mu$m.

What is claimed is:

1. A method of applying a coating on an article, the method comprising:

depositing a predetermined quantity of coating on a surface of the article;

spreading the coating by causing the article to revolve; and applying the coating directly to a surface of the article which is not covered by said predetermined quantity of coating spreading under the effect of centrifugal force, said article being hollow and comprising a bottom and a side wall, wherein a coating is in addition deposited inside the article, and wherein the quantity of coating deposited is sufficient to enable it to rise under the effect of centrifugal force at least part of the way up the side wall of the article.

2. A method according to claim 1, wherein the direct application of the coating takes place simultaneously with rotation of the article.

3. A method according to claim 1, wherein the direct application consists in spraying.

4. A method according to claim 1, wherein the direct application is performed by a nozzle whose positioning and orientation are adjustable.

5. A method according to claim 1, wherein the coating which spreads under the effect of centrifugal force is deposited on the surface at the moment when it is set into rotation and wherein a nozzle is used for applying the coating directly to the surface of the article, said nozzle being downwardly inclined and situated slightly above the periphery of said surface.

6. A method according to claim 5, wherein said surface is generally rectangular in shape when observed from above.

7. A method according to claim 1, wherein rotation of the article is stopped suddenly after the coating has spread by the desired amount.

8. A method according to claim 1, wherein the coating is without organic solvent.

9. A method according to claim 1, wherein the coating is heated by being raised to a temperature higher than ambient temperature.

10. A method according to claim 9, wherein the coating is heated to a temperature lying in the range 40° C. to 50° C.

11. A method according to claim 1, wherein the side wall is, at least in part, parallel to the axis of rotation about which the article is rotated.

12. A method according to claim 1, wherein the side wall of the article is stepped.

13. A method according to claim 1, wherein the quantity of coating deposited on said bottom is sufficient to enable the coating to cover the top edge of the article after rising up the side wall.

14. A method according to claim 1, wherein the coating which spreads under the effect of centrifugal force is deposited on a surface which is substantially plane or slightly convex.

15. A method according to claim 1, wherein, when the coating that is to be spread under the effect of centrifugal force is deposited, the speed of the article is zero or substantially zero.

16. A method according to claim 14, wherein the surface is generally rectangular in shape when observed from above at the moment when the surface is set into rotation to spread the coating under the effect of centrifugal force, and wherein a means for applying the coating directly to the surface of the article comprises a nozzle that is downwardly inclined and situated slightly above the periphery of said convex surface.

17. A method according to claim 1, wherein a coating is used that is capable of being cured under the effect of ultraviolet radiation.

18. A method according to claim 17, wherein the coating deposited on the article is caused to be cured while the article is still in rotation.

19. A method according to claim 1, wherein the article is constituted by a container body, a container lid, a stopper, or a flask.

20. A method according to claim 1, wherein said coating is selected from the group consisting of a varnish and a paint.

21. A method according to claim 1, wherein said coating is in a fluid state.

22. A method according to claim 1, wherein the coating is deposited on a center area of said bottom, said center area being spaced from said side wall.

23. A method according to claim 1, wherein said bottom having an outer surface, wherein said coating is deposited on said outer surface.

24. A method according to claim 1, wherein the predetermined quantity of coating is deposited on said bottom without said coating contacting said side wall.

25. A method according to claim 1, wherein the coating which spreads under the effect of centrifugal force is deposited on an outside surface of the article.

* * * * *